US010825441B2

(12) United States Patent
Bowers et al.

(10) Patent No.: US 10,825,441 B2
(45) **Date of Patent: *Nov. 3, 2020**

(54) STEERABLE ACOUSTIC RESONATING TRANSDUCER SYSTEMS AND METHODS

(71) Applicant: Elwha LLC, Bellevue, WA (US)

(72) Inventors: Jeffrey A. Bowers, Bellevue, WA (US); Paul Duesterhoft, Issaquah, WA (US); Daniel Hawkins, Pleasanton, CA (US); Roderick A. Hyde, Redmond, WA (US); Edward K. Y. Jung, Las Vegas, NV (US); Jordin T. Kare, Seattle, WA (US); Eric C. Leuthardt, St. Louis, MO (US); Nathan P. Myhrvold, Bellevue, WA (US); Clarence T. Tegreene, Mercer Island, WA (US); Lowell L. Wood, Jr., Bellevue, WA (US); Michael A. Smith, Phoenix, AZ (US)

(73) Assignee: Elwha LLC, Bellevue, WA (US)

( * ) Notice: Subject to any disclaimer, the term of this patent is extended or adjusted under 35 U.S.C. 154(b) by 413 days.

This patent is subject to a terminal disclaimer.

(21) Appl. No.: 15/683,517

(22) Filed: Aug. 22, 2017

(65) Prior Publication Data

US 2018/0090124 A1 Mar. 29, 2018

Related U.S. Application Data

(63) Continuation of application No. 14/279,110, filed on May 15, 2014, now Pat. No. 9,741,335.

(51) Int. Cl.
*G10K 11/34* (2006.01)
*H04R 1/40* (2006.01)

(52) U.S. Cl.
CPC ..... *G10K 11/345* (2013.01); *G10K 11/34* (2013.01); *G10K 11/343* (2013.01); *H04R 1/40* (2013.01); *H04R 2201/401* (2013.01)

(58) Field of Classification Search
CPC .. H04R 1/40; H04R 2201/401; G10K 11/343; G10K 11/34; G10K 11/345
(Continued)

(56) References Cited

U.S. PATENT DOCUMENTS 9,741,335 B2 * 8/2017 Bowers ..... H04R 1/40
2014/0098979 A1 * 4/2014 Osborn ..... H04R 1/2834 381/300

OTHER PUBLICATIONS

J. Kellner et al., "Piezoceramic Ultrasonic Transducer with Frequency Controlled Radiation Pattern", Technology Conference—IMTC 2007, Warsaw, Poland, May 1-3, 2007.

* cited by examiner

*Primary Examiner* — Daniel L Murphy

(57) ABSTRACT

The present disclosure provides systems and methods associated with acoustic transmitters, receivers, and antennas. Specifically, the present disclosure provides a transducer system for transmitting and receiving acoustic energy according to a determined acoustic emission/reception pattern. In various embodiments, an acoustic transducer system may include an array of sub-wavelength transducer elements each configured with an electromagnetic resonance at one of a plurality of electromagnetic frequencies. Each sub-wavelength transducer element may generate an acoustic emission in response to the electromagnetic resonance. A beamforming controller may cause electromagnetic energy to be transmitted at select electromagnetic frequencies to cause a select subset of the sub-wavelength transducer elements to generate acoustic emissions according to a selectable acoustic transmission pattern. A common port may facilitate
(Continued)

electromagnetic communication with each of the sub-wavelength transducer elements.

40 Claims, 6 Drawing Sheets

(58) Field of Classification Search
USPC ..... 367/138, 140
See application file for complete search history.

STEERABLE ACOUSTIC RESONATING TRANSDUCER SYSTEMS AND METHODS

If an Application Data Sheet (ADS) has been filed on the filing date of this application, it is incorporated by reference herein. Any applications claimed on the ADS for priority under 35 U.S.C. §§ 119, 120, 121, or 365(c), and any and all parent, grandparent, great-grandparent, etc., applications of such applications are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 U.S.C. § 119(e) for provisional patent applications, for any and all parent, grandparent, great-grandparent, etc., applications of the Priority Application(s)). In addition, the present application is related to the "Related Applications," if any, listed below.

PRIORITY APPLICATIONS

This application is a continuation of U.S. patent application Ser. No. 14/279,110, filed May 15, 2014, for STEERABLE ACOUSTIC RESONATING TRANSDUCER SYSTEMS AND METHODS, which is incorporated herein by reference.

RELATED APPLICATIONS

If the listings of applications provided above are inconsistent with the listings provided via an ADS, it is the intent of the Applicant to claim priority to each application that appears in the Priority Applications section of the ADS and to each application that appears in the Priority Applications section of this application.

All subject matter of the Priority Applications and the Related Applications and of any and all parent, grandparent, great-grandparent, etc. applications of the Priority Applications and the Related Applications, including any priority claims, is incorporated herein by reference to the extent such subject matter is not inconsistent herewith.

TECHNICAL FIELD

This disclosure relates to acoustic phased arrays and metamaterial acoustic transducer systems. Specifically, this disclosure relates to sub-wavelength transducers addressable via selective electromagnetic resonance.

SUMMARY

The present disclosure includes various systems and methods for generating and receiving acoustic transmissions according to a dynamically selectable acoustic pattern or beam-form. In various embodiments, an array of sub-wavelength transducer elements may be configured to transmit an acoustic emission or receive an acoustic emission according to a specific pattern, direction, beam-formed shape, location, phase, amplitude, and/or other transmission/reception characteristic.

For example, according to various embodiments for acoustic transmission according to a transmission pattern, each sub-wavelength transducer element may be configured with an electromagnetic resonance at one of a plurality of electromagnetic frequencies. Each sub-wavelength transducer element may also be configured to generate an acoustic emission in response to the electromagnetic resonance.

The sub-wavelength transducer elements may be described as "sub-wavelength" because a wavelength of the acoustic emission of each respective sub-wavelength transducer element may be larger than a physical diameter of the respective sub-wavelength transducer element. For example, the physical diameter of one or more of the sub-wavelength transducer elements may be less than one-half the wavelength of the acoustic transmission within a given transmission medium. In some embodiments, the physical diameter may be less than one-half of the wavelength divided by the sine of theta, where theta is the maximum beam steering angle with respect to the normal of the array of sub-wavelength transducer elements.

A beam-forming controller may be configured to cause electromagnetic energy to be transmitted by one or more electromagnetic energy sources at select electromagnetic frequencies to resonate with a select subset of the sub-wavelength transducer elements to cause the resonating sub-wavelength transducer elements to generate acoustic emissions according to a selectable acoustic transmission pattern. The electromagnetic energy may be conveyed to the various sub-wavelength transducer elements via a common port, such as a waveguide or free space.

Similarly, acoustic transducer systems may receive acoustic energy via a select subset of the sub-wavelength transducer elements at a given time. Accordingly, the acoustic transducer system may receive acoustic transmissions according to a specific acoustic receiving pattern, beam pattern, direction, focus, location, or other acoustic transmission characteristic.

DETAILED DESCRIPTION

Figure 1A:
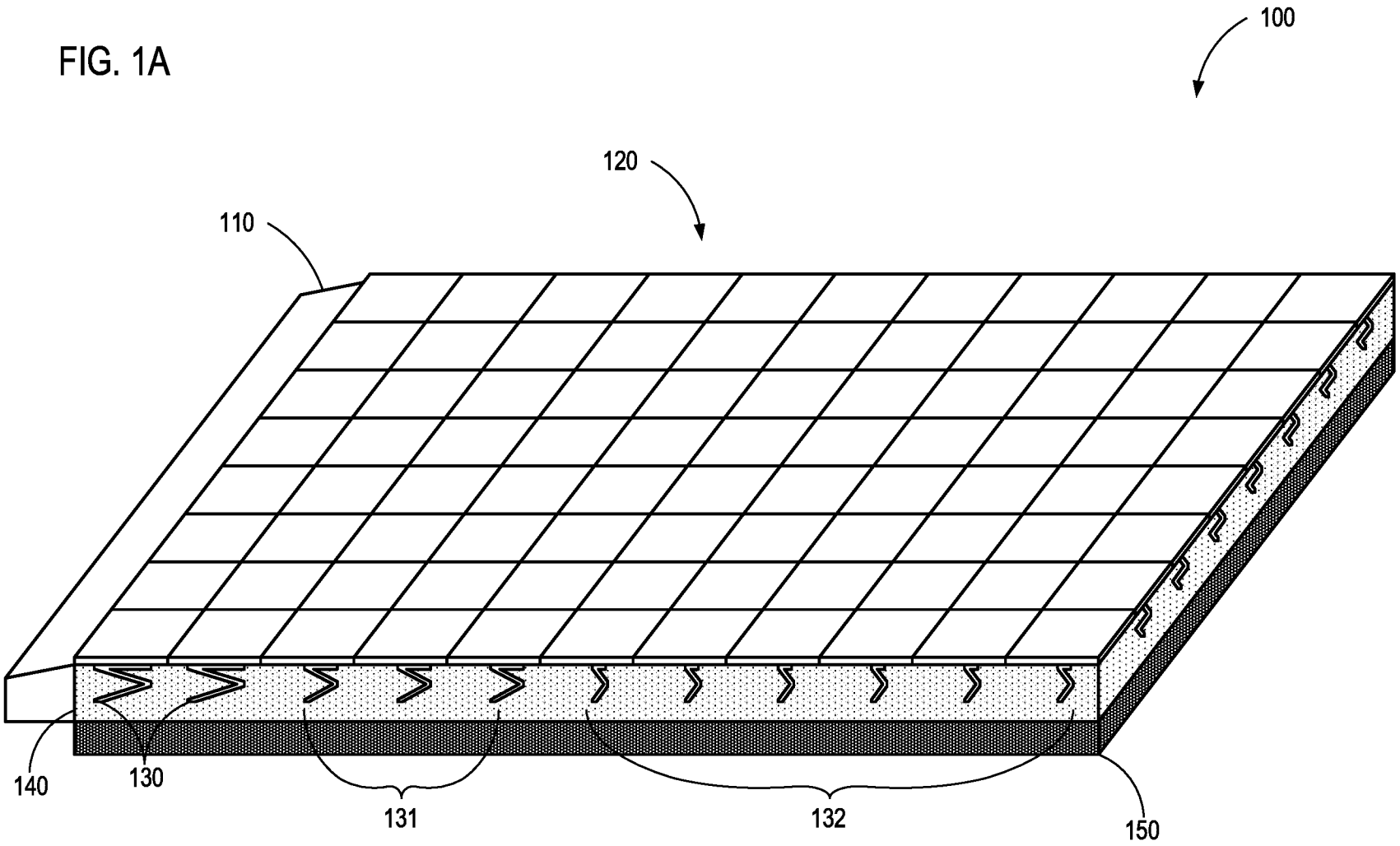
FIG. 1A illustrates a representation of an array of sub-wavelength transducer elements, each of which is configured to resonate at a particular electromagnetic frequency and generate a responsive acoustic emission.

According to the various embodiments described herein, a specific acoustic pattern (e.g., a beam-formed acoustic transmission) is generated by selectively activating individual or groups of sub-wavelength transducer elements in an array of sub-wavelength transducer elements.

For example, an acoustic transducer system may include an array of sub-wavelength transducer elements. Each sub-wavelength transducer element in the array of sub-wavelength transducer elements may be configured to resonate with a particular electromagnetic frequency. The electromagnetic resonance of each sub-wavelength transducer element may cause an acoustic emission. Similarly, the reception of acoustic energy may cause the sub-wavelength transducer element to emit, absorb, and/or modulate electromagnetic energy.

Thus, each sub-wavelength transducer element in the array of sub-wavelength transducer elements may be configured to convert electromagnetic energy to acoustic energy and/or acoustic energy to electromagnetic energy. In some embodiments, each sub-wavelength transducer element is configured to convert energy in both directions. That is, each sub-wavelength transducer elements may be configured to convert electromagnetic energy to acoustic energy and acoustic energy to electromagnetic energy.

In other embodiments, some sub-wavelength transducer elements are configured to convert electromagnetic energy to acoustic energy and other sub-wavelength transducer elements are configured to convert acoustic energy to electromagnetic energy.

In some embodiments, each sub-wavelength transducer element in the array of sub-wavelength transducer elements may be configured to resonate at a different electromagnetic frequency(ies). Accordingly, each sub-wavelength transducer element within the array of sub-wavelength transducer elements may be uniquely addressable via the unique resonant frequency.

In other embodiments, the array of sub-wavelength transducer elements may be divided into sets of sub-wavelength transducer elements, where each set includes one or more sub-wavelength transducer elements. Each set may resonate at a unique frequency, such that each sub-wavelength transducer element in a particular set resonates at the same frequency as other sub-wavelength transducer elements in the particular set, but at a different frequency than sub-wavelength transducer elements in a different set. Thus, a set of sub-wavelength transducer elements may be group-addressable via a single electromagnetic frequency. Multiple sets of sub-wavelength transducer elements may be addressable via multiple corresponding electromagnetic frequencies.

A set of sub-wavelength transducer elements may include any number of sub-wavelength transducer elements that are contiguously located within the array of sub-wavelength transducer elements. Alternatively, a set of sub-wavelength transducer elements may include any number of sub-wavelength transducer elements that are disparately, randomly, stochastically (with respect to other subsets), or strategically located within the array of sub-wavelength transducer elements.

Each respective sub-wavelength transducer element may be configured to generate and/or receive an acoustic signal at a wavelength having a larger wavelength than the diameter and/or depth of the respective sub-wavelength transducer element. As will be appreciated by one of skill in the art, each embodiment or example described in terms of a transmitter may be equally applicable to receiving arrays of sub-wavelength transducer elements. Similarly, each embodiment or example described in terms of a receiver may be equally applicable to transmitting arrays of sub-wavelength transducer elements.

A controller in communication with the array of sub-wavelength transducer elements may be configured to selectively transmit (or receive) electromagnetic energy at the resonant frequency of a select subset of sub-wavelength transducer elements in the array of sub-wavelength transducer elements. The select subset may include one or more uniquely-addressable individual sub-wavelength transducer elements and/or one or more sets of group-addressable sub-wavelength transducer elements.

The controller may be in communication with the array of sub-wavelength transducer elements via a common port. In some embodiments, an electromagnetic transmitter may be configured to communication via a free-space common port; in other embodiments, the common port may be embodied as an antenna, a waveguide, and/or other electromagnetic transmitting structure.

Each sub-wavelength transducer element may be configured with an electromagnetic resonance at one of a plurality of carrier electromagnetic frequencies. Resonance at the carrier frequency may cause an acoustic emission at a modulation frequency associated with the carrier frequency.

Accordingly, each sub-wavelength transducer element or set of sub-wavelength transducer elements may be configured to resonate at unique electromagnetic carrier frequencies and emit acoustic energy at the same frequency (by using a common modulation or side band frequency) or varying frequencies (by using unique modulation or side band frequencies). A carrier frequency may be between 2 and 10 (or more) times larger than the modulation frequency. Similarly, side band frequencies may be spaced from the carrier frequency by a percentage of the carrier frequency.

As an example, one or more sub-wavelength transducer elements may be configured with an electromagnetic resonance of 10 MHz, one or more other sub-wavelength transducer elements may be configured with an electromagnetic resonance at 15 MHz, and other sets of one or more sub-wavelength transducer elements at 20 MHz, 25 MHz, and so forth. Each sub-wavelength transducer element may be configured to generate an acoustic emission in response to receiving a resonating electromagnetic signal. The generated acoustic emission may correspond to a fixed acoustic frequency associated with the resonating electromagnetic frequency and/or a modulation frequency associated with the resonating electromagnetic frequency.

For instance, in the example above, a modulation frequency of 30 kHz may be present on each of the electromagnetic signals. According to various embodiments, by selectively transmitting electromagnetic signals at 10 MHz, 15 MHz, 20 MHz, 25 MHz, and so forth, the array of sub-wavelength transducer elements may be selectively controlled to transmit acoustic energy from only those sub-wavelength transducer elements receiving a resonating electromagnetic signal. The transmitted acoustic signal may be at the modulation frequency of 30 kHz. The amplitude and/or phase of each acoustic signal transmitted by each sub-wavelength transducer element may be varied by adjusting the amplitude and/or phase of the modulation frequency. Each respective carrier frequency may be separated a sufficient number of frequency channels to prevent or reduce the likelihood of interference due to modulation and/or side band channels.

The amplitudes and/or phases of one or more carrier frequencies, side band frequencies, and/or modulation frequencies may be modified to dynamically adjust the acoustic transmission transmitted by the collective array of sub-wavelength transducer elements. A specific acoustic transmission pattern may be produced by inducing sub-wavelength transducer elements to generate an acoustic transmission. The specific acoustic transmission may be generated and/or modified by varying one or more characteristic (e.g., phase, amplitude, and/or frequency) of the resonating electromagnetic energy, electromagnetic energy at the resonating carrier frequency, side band of the resonating carrier frequency, and/or modulation frequency(ies) of the resonating carrier frequency.

In various embodiments, the specific acoustic pattern may include a beam-formed acoustic transmission, a pseudo-random acoustic transmission, a focused beam acoustic transmission, a collimated, random pattern acoustic transmission, an audible transmission, and/or an ultrasonic transmission. For example, an ultrasonic transmission may include acoustic transmissions between 20 kHz and 1 GHz. In other embodiments, the acoustic transmission may be between 20 Hz and 20 KHz, or even in the sub-audible range. A single system or variations of the same system may utilize frequencies between 2 Hz and 1 GHz, or higher.

In various embodiments, the electromagnetic energy may be generated by one or more electromagnetic energy sources. One or more controllers or sub-controllers may control the one or more electromagnetic energy sources to cause them to transmit electromagnetic energy via a common port to the array of sub-wavelength transducer elements. For example, in some embodiments a system may include a microwave energy source.

A controller may adjust one or more of the phase and time-of-transmission of the electromagnetic energy based on a time delay or phase delay associated with the position of one or more of the sub-wavelength transducer elements relative to the controller and/or electromagnetic energy source.

The sub-wavelength transducer elements may comprise resonator elements, such as, for example, metamaterial sub-wavelength transducer elements. The sub-wavelength transducer elements may comprise piezoelectric transducers, ferroelectric polymer transducers, acoustically tunable transducer elements, electromagnetically tunable transducer elements, filters, capacitors, nematic liquid crystal, plasmonic metamaterial transducers, tunable active acoustic metamaterial transducers, dynamically controllable circuit elements, inductors, and/or various other components.

The spacing distance between each of the sub-wavelength transducer elements may be less than ½, ⅓, 1/10 of an acoustic wavelength in the surrounding medium, contiguously spaced with shared edges, and/or otherwise spaced within the array of sub-wavelength transducer elements. Furthermore, in some embodiments, the sub-wavelength transducer elements may be evenly spaced and in other embodiments they may be randomly, stochastically, and/or otherwise spaced within the array of sub-wavelength transducer elements.

In some embodiments, the spacing may be specifically chosen based on a desired acoustic transmission possibility. In some embodiments, the sub-wavelength transducer elements comprise a continuous surface of sub-wavelength transducer elements. The array of sub-wavelength transducer elements may comprise one or more impedance matching layers. The sub-wavelength transducer elements may be in the form of a flexible array of sub-wavelength transducer elements.

The array of sub-wavelength transducer elements may comprise a one-dimensional array of sub-wavelength transducer elements, a two-dimensional array of sub-wavelength transducer elements, and/or a three-dimensional array of sub-wavelength transducer elements. The sub-wavelength transducer elements in an array of sub-wavelength transducer elements may or may not be coplanar with one another. For example, an array of sub-wavelength transducer elements may be disposed on a flexible medium allowing the array to be curved and/or conform to a wide variety of surfaces and shapes.

In some embodiments, position detection elements may provide sufficient positional information to a controller to allow the controller to dynamically modify which sub-wavelength transducer elements are activated (caused to resonate) to continually and dynamically produce and/or receive a specific acoustic pattern(s).

Examples of suitable carrier frequencies may include those in the ultrasonic band between 20 kHz and 100 MHz. Modulation frequencies and/or side band frequencies may be based on the carrier frequency and be between 20 kHz and 20 MHz. Suitable carrier frequencies may depend on the desired acoustic (including ultrasonic, sonic, and subsonic) frequencies, and on the configuration of the transducer system. For example, for medical ultrasound, ultrasonic frequencies are typically between 1 and 10 MHz, and carrier frequencies in this case may be between 100 MHz and 10 GHz. Acoustic transducers for sonar applications may operate at acoustic frequencies of 10 kHz-1 MHz, and are comparatively large; suitable carrier frequencies in this case may be 1 MHz to 1 GHz. As provided above, each of the sub-wavelength transducer elements may be configured with an electromagnetic resonance at a unique frequency(ies) and/or pairs or groups of sub-wavelength transducer elements may be configured with similar or identical electromagnetic frequency resonances.

According to various embodiments, an acoustic transducer system may be configured to receive an acoustic signal at a wavelength larger than a physical diameter of each of the sub-wavelength transducer elements and generate a corresponding electromagnetic transmission at one of a plurality of electromagnetic carrier frequencies. In some embodiments, the electromagnetic carrier frequency generated by a sub-wavelength transducer element may become a modulation frequency of a higher carrier frequency transmitted and/or received via the common port.

At least one of the sub-wavelength transducer elements may be configured to generate an electromagnetic transmission at a first carrier frequency and at least one other of the sub-wavelength transducer elements may be configured to generate an electromagnetic transmission at a second, different carrier frequency.

A receiver may be configured to receive the electromagnetic transmission from each of the sub-wavelength transducer elements. In some embodiments, a controller may selectively control from which of the sub-wavelength transducer elements the receiver receives the electromagnetic transmissions, thereby allowing the array of sub-wavelength transducer elements to receive a specific acoustic pattern. Similar to other embodiments, a common port may facilitate electromagnetic communication between the receiver(s) and each of the sub-wavelength transducer elements.

The transmitter, receiver, and/or transceiver systems described above may be utilized in any of a wide variety of manners. In any of a wide variety of embodiments, an acoustic transmission pattern may be emitted by a plurality of sub-wavelength transducer elements. Each sub-wavelength transducer element may be configured with an electromagnetic resonance at one of a plurality of electromagnetic frequencies.

Each of the respective sub-wavelength transducer elements may be configured to generate an acoustic emission in response to the electromagnetic resonance. In some embodiments, the sub-wavelength transducer elements may be (alternatively or additionally) configured to generate an electromagnetic transmission, resonance, and/or interference pattern in response to an acoustic input. For example, in some embodiments, the sub-wavelength transducer elements may cause a reflected and/or refracted electromagnetic energy to be frequency and/or phase modulated.

A transmitter may transmit energy in at least two of the plurality of electromagnetic frequencies that resonates with a subset of the sub-wavelength transducer elements to generate ultrasonic emissions corresponding to the specific acoustic transmission pattern. The electromagnetic energy may be conveyed via a common port to each of the sub-wavelength transducer elements Many existing computing devices and infrastructures may be used in combination with the presently described systems and methods. Some of the infrastructure that can be used with embodiments disclosed herein is already available, such as general-purpose computers, computer programming tools and techniques, digital storage media, and communication links. A computing device or controller may include a processor, such as a microprocessor, a microcontroller, logic circuitry, or the like. A processor may include a special purpose processing device, such as application-specific integrated circuits (ASIC), programmable array logic (PAL), programmable logic array (PLA), programmable logic device (PLD), field programmable gate array (FPGA), or other customizable and/or programmable device. The computing device may also include a machine-readable storage device, such as non-volatile memory, static RAM, dynamic RAM, ROM, CD-ROM, disk, tape, magnetic, optical, flash memory, or other machine-readable storage medium. Various aspects of certain embodiments may be implemented using hardware, software, firmware, or a combination thereof.

The embodiments of the disclosure will be best understood by reference to the drawings, wherein like parts are designated by like numerals throughout. The components of the disclosed embodiments, as generally described and illustrated in the figures herein, could be arranged and designed in a wide variety of different configurations. Furthermore, the features, structures, and operations associated with one embodiment may be applicable to or combined with the features, structures, or operations described in conjunction with another embodiment. In other instances, well-known structures, materials, or operations are not shown or described in detail to avoid obscuring aspects of this disclosure.

Thus, the following detailed description of the embodiments of the systems and methods of the disclosure is not intended to limit the scope of the disclosure, as claimed, but is merely representative of possible embodiments. In addition, the steps of a method do not necessarily need to be executed in any specific order, or even sequentially, nor do the steps need to be executed only once. As described above, descriptions and variations described in terms of transmitters are equally applicable to receivers, and vice versa.

FIG. 1A illustrates a representation of an acoustic transducer system 100 with an array of sub-wavelength transducer elements 120, each of which is configured to resonate at a particular electromagnetic frequency and generate a responsive acoustic emission. Again, the illustrated embodiments are merely illustrative. That is, the actual shape, size, dimensions, and other illustrated characteristics are merely representative and are not intended to convey any absolute or relative details regarding the physical nature of the various components.

In the illustrated embodiment, a controller 110 is in electrical and/or electromagnetic communication with each of the sub-wavelength transducer elements 120. The controller may be in electromagnetic communication via a common port 140. The common port 140 may comprise free space, a resonant cavity, or a wave guide.

The acoustic transducer system 100 may include an array of sub-wavelength transducer elements 120. Each sub-wavelength transducer element 120 in the array of sub-wavelength transducer elements 120 may be configured to resonate with a particular electromagnetic frequency. The electromagnetic resonance of each sub-wavelength transducer element 120 may cause an acoustic emission. Similarly, the reception of acoustic energy may cause each sub-wavelength transducer element 120 to emit electromagnetic energy. The illustrated antennas 130, 131, and 132 may represent the ability of each sub-wavelength transducer element to receive and/or transmit electromagnetic energy in response to transmissions from the controller 110 and/or externally received acoustic energy.

Thus, each sub-wavelength transducer element 120 in the array of sub-wavelength transducer elements 120 may be configured to convert electromagnetic energy to acoustic energy and/or acoustic energy to electromagnetic energy. In some embodiments, each sub-wavelength transducer element 120 is configured to convert energy in both directions. That is, each sub-wavelength transducer element 120 may be configured to convert electromagnetic energy to acoustic energy and acoustic energy to electromagnetic energy.

In other embodiments, some sub-wavelength transducer elements 120 are configured to convert electromagnetic energy to acoustic energy and other sub-wavelength transducer elements 120 are configured to convert acoustic energy to electromagnetic energy.

In some embodiments, each sub-wavelength transducer element 120 in the array of sub-wavelength transducer elements may be configured to resonate at a different frequency. That is, each sub-wavelength transducer element 120 in the array of sub-wavelength transducer elements may be configured to resonate at a different and unique frequency. Accordingly, each sub-wavelength transducer element 120 within the array of sub-wavelength transducer elements may be uniquely addressable via a unique resonant frequency.

In other embodiments, the array of sub-wavelength transducer elements 120 may be divided into sets of sub-wavelength transducer elements, where each set includes one or more sub-wavelength transducer elements. For example, a first set may include all sub-wavelength transducer elements that resonate at a first electromagnetic frequency (represented by antennas 130). A second set may include all sub-wavelength transducer elements that resonate at a second electromagnetic frequency (represented by antennas 131). A third set may include all sub-wavelength transducer elements that resonate at a third electromagnetic frequency (represented by antennas 132). In other embodiments, any number of sets, each configured to resonate at a unique electromagnetic frequency, may be part of the array of sub-wavelength transducer elements 120. Communication with each of the antennas 130, 131, and 132 may be facilitated by a common port 140. A reflecting or non-reflecting plate 150 may cooperate with the common port 140. For instance, in some embodiments, the common port 140, in conjunction with the reflecting or non-reflecting plate 150, may be a waveguide.

As described above, each set may resonate at a unique frequency, such that each sub-wavelength transducer element 120 in a particular set (those associated with antennas 103, 131, or 132) resonates at the same frequency as other sub-wavelength transducer elements 120 in the same set, but at a different frequency than sub-wavelength transducer elements 120 in a different set. Thus, a set of sub-wavelength transducer elements 120 may be group-addressable via a single electromagnetic frequency. Multiple sets of sub-wavelength transducer elements 120 may be addressable via multiple corresponding electromagnetic frequencies.

As will be appreciated by one of skill in the art, each embodiment or example described in terms of a transmitter may be equally applicable to receiving arrays of sub-wavelength transducer elements 120. Similarly, each embodiment or example described in terms of a receiver may be equally applicable to transmitting arrays of sub-wavelength transducer elements 120.

Figure 1B:
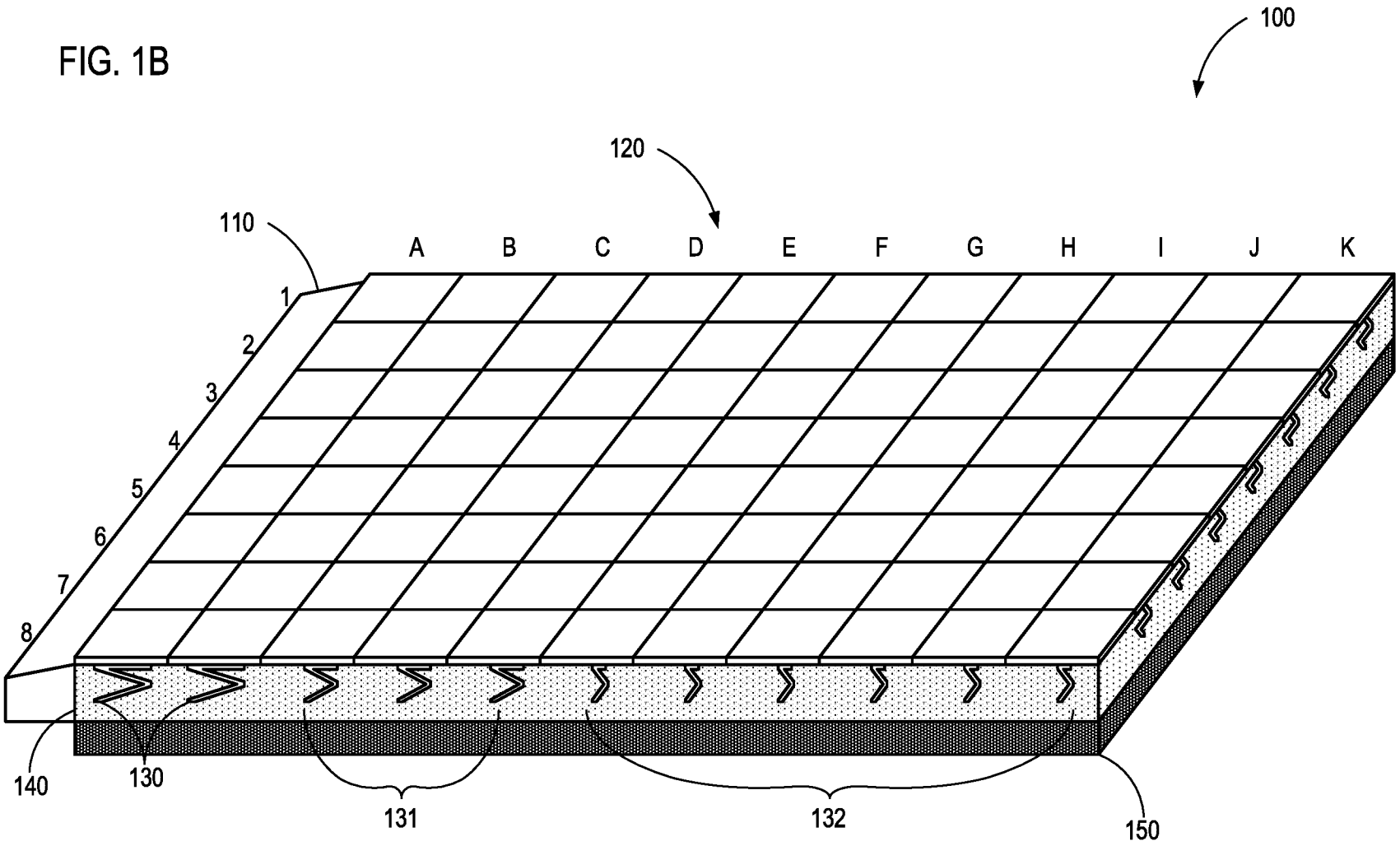
FIG. 1B illustrates the representation of the array of sub-wavelength transducer elements illustrated in FIG. 1A, with reference to column and row information for clarity.

FIG. 1B illustrates the representation of an acoustic transducer system 100 illustrated in FIG. 1A with reference to column and row information for clarity. As described above, sub-wavelength transducer elements 120 may be divided into sets of sub-wavelength transducer elements, where each set includes one or more sub-wavelength transducer elements. For example, a first set may include sub-wavelength transducer elements 120 in columns A and B that resonate at a first electromagnetic frequency (represented by antennas 130). A second set may include sub-wavelength transducer elements in columns C, D, and E that resonate at a second electromagnetic frequency (represented by antennas 131). A third set may include sub-wavelength transducer elements in columns F-G that resonate at a third electromagnetic frequency (represented by antennas 132). In other embodiments, any number of sets, each configured to resonate at a unique electromagnetic frequency may be part of the array of sub-wavelength transducer elements 120.

For instance, in some embodiments, each column may resonate at a unique electromagnetic frequency. In such an embodiment, a controller 110 may be able to individually drive each column by transmitting a unique electromagnetic frequency. For example, sub-wavelength transducer elements in column A may be configured to resonate at 1 MHz, sub-wavelength transducer elements in column B may be configured to resonate at 2 MHz, sub-wavelength transducer elements in column C may be configured to resonate at 3 MHz, and so on until sub-wavelength transducer elements in column K are configured to resonate at 11 MHz. The separation between resonant frequencies of each column may be greater than or less than the example above of 1 MHz. Moreover, the resonant frequencies may be orders of magnitude higher or lower than the MHz range.

In such an embodiment, the controller 110 may transmit electromagnetic energy at 3 MHz to cause each of the sub-wavelength transducer elements in column C to generate an acoustic emission at a frequency $F_a$, where $F_a$ is any acoustic frequency ranging from audible to extreme ultrasonic. The controller 110 may simultaneously and/or successively transmit electromagnetic energy at various other frequencies to cause the sub-wavelength transducer elements in the other columns to generate an acoustic emission at a frequency $F_a$. In some embodiments, selective modulation, frequency shifting, phase shifting, and/or other variation on each of the transmitted electromagnetic energy frequencies may cause the sub-wavelength transducer elements to generate an acoustic emission at a frequency $F_{a+K}$, $KF_a$, $F_{ak}$, where K is associated with the modulation, frequency shifting, phase shifting or other variation on each of the transmitted electromagnetic energy.

By controlling which sub-wavelength transducer elements generate an acoustic emission and when, the controller 110 can control the constructive and destructive interference of acoustic emissions from the acoustic transducer system 100. Specifically, the controller 110 may allow the acoustic transducer system to generate a specific acoustic transmission pattern. Similarly, the controller may selectively "listen" (whether actively or passively) to each set of sub-wavelength transducer elements to receive an acoustic signal from a particular direction.

In other embodiments, any combination of sub-wavelength transducer elements may be grouped in a set. For example, a set of sub-wavelength transducer elements may include sub-wavelength transducer elements listed by column and row as follows: A1, B2, C3, D1, E2, F3. Alternatively, they may be grouped in any other conceivable arrangement.

As in other embodiments described herein, each embodiment or example described in terms of a transmitter may be equally applicable to receiving arrays of sub-wavelength transducer elements 120. Similarly, each embodiment or example described in terms of a receiver may be equally applicable to transmitting arrays of sub-wavelength transducer elements 120.

Figure 2:
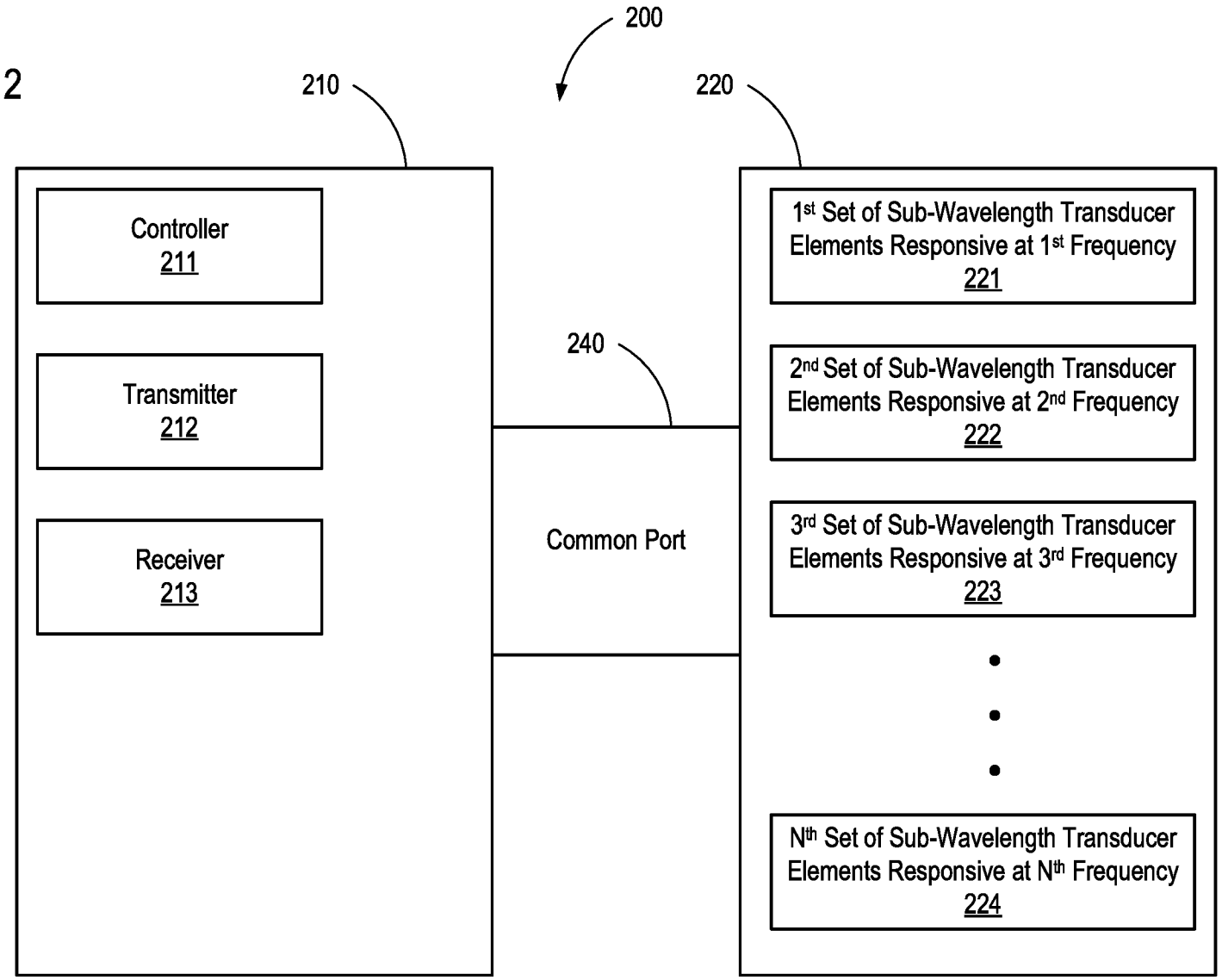
FIG. 2 illustrates a block diagram of an acoustic transducer system, including an array of sub-wavelength transducer elements.

FIG. 2 illustrates a block diagram of an acoustic transducer system 200, including an array of sub-wavelength transducer elements 220. The array of sub-wavelength transducer elements 220 may include a number of sets of sub-wavelength transducer elements, each of which sets is responsive to a common frequency of electromagnetic energy. That is, each sub-wavelength transducer element in a set of sub-wavelength transducer elements may resonate with a frequency or narrow frequency band of electromagnetic energy. Accordingly, the reception of resonating electromagnetic energy may cause the sub-wavelength transducer element to generate an acoustic emission. Similarly, in some embodiments, the reception of acoustic energy by sub-wavelength transducer elements may generate electromagnetic energy.

A controller module 210 may include a controller 211, a transmitter 212, and/or a receiver 213 in communication with the array of sub-wavelength transducer elements 220 via a common port 240. The controller module 210 and its components, such as the controller 211, may be implemented in software, firmware, and/or hardware. The controller 211 may drive the transmitter 212 to transmit electromagnetic energy via the common port to the array of sub-wavelength transducer elements 220. The controller 211 may cause the transmitter 212 to transmit specific frequencies to drive one or more sets of sub-wavelength transducer elements 221-224 to cause them to generate an acoustic emission. By selectively driving a different set or sets of sub-wavelength transducer elements at discrete intervals of time, any of a wide variety of acoustic transmission patterns may be realized. Each set of sub-wavelength transducer elements may include one or more sub-wavelength transducer elements.

In some embodiments, the controller 211 may cause the receiver 213 to receive electromagnetic energy from a different set or sets of sub-wavelength transducer elements at discrete intervals of time. Each set of sub-wavelength transducer elements may transmit electromagnetic energy to the receiver based on converted acoustic energy received by the sub-wavelength transducer element. In some embodiments, the receiver may be configured to actively listen to each sub-wavelength transducer element. In such an embodiment, each sub-wavelength transducer element may modify electromagnetic energy that is ultimately received by the receiver 213.

Figure 3:
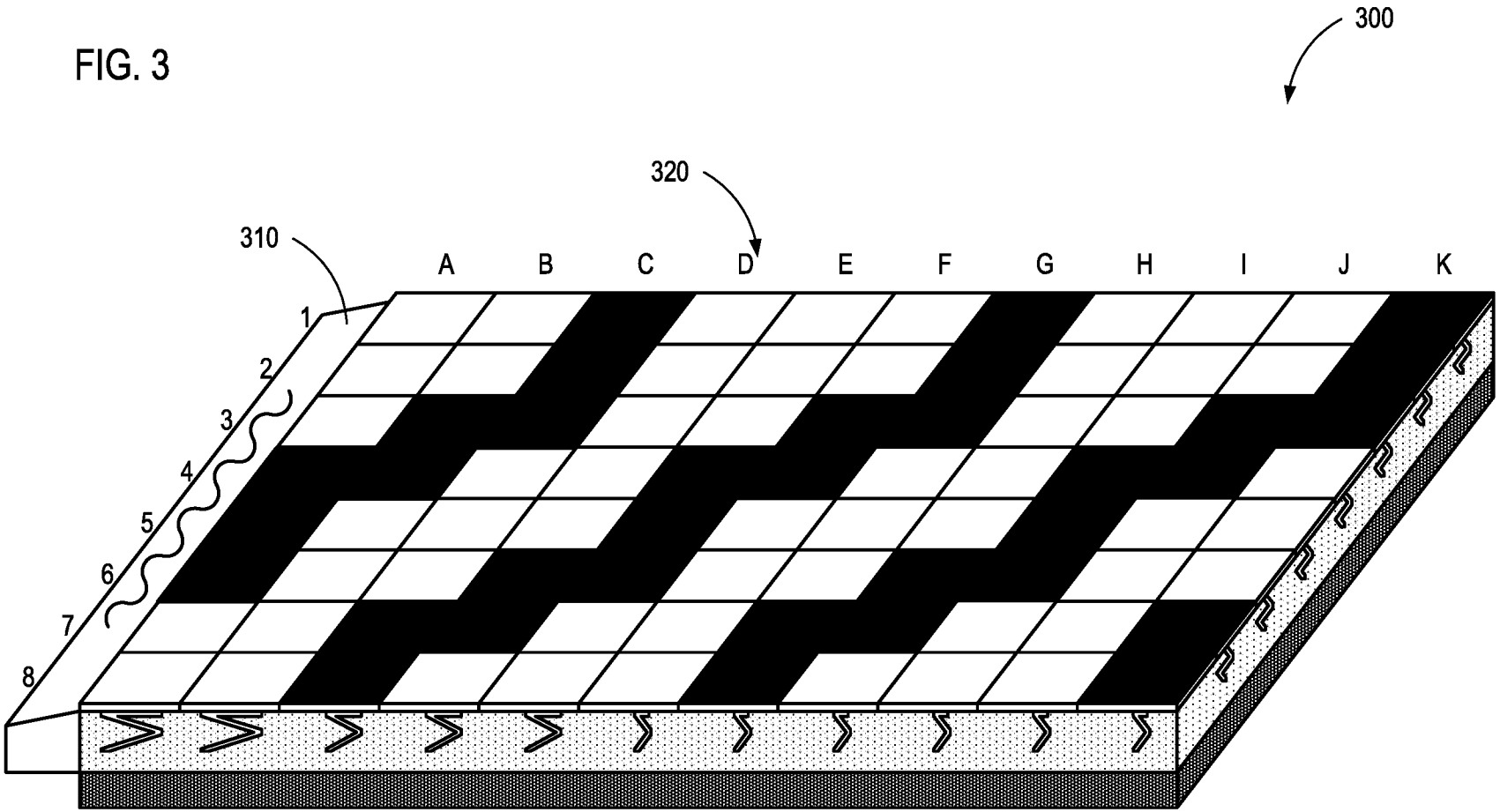
FIG. 3 illustrates a representation of an array of sub-wavelength transducer elements with a subset of sub-wavelength transducer elements resonating at various electromagnetic frequencies and generating a corresponding acoustic emission.

FIG. 3 illustrates a representation of an acoustic transducer system 300, including an array of sub-wavelength transducer elements 320. The array of sub-wavelength transducer elements includes a subset of sub-wavelength transducer elements (shown in black) resonating at various electromagnetic frequencies and generating a corresponding acoustic emission (not shown). The illustrated representation shows the controller 310 causing electromagnetic energy at one or more frequencies to cause the sub-wavelength transducer elements (shown in black) to generate an acoustic emission. The controller 310 may cause various sub-wavelength transducer elements to dynamically generate acoustic emissions over time in order to generate a desired acoustic emission pattern. By dynamically changing which sub-wavelength transducer elements are driven/activated (i.e., receive resonant electromagnetic energy), the controller can dynamically modify the generated acoustic emission pattern as well. For example, the controller may dynamically modify a directional beam-formed acoustic transmission (e.g., change a direction, angle, intensity, phase, frequency, and/or other characteristic of an acoustic transmission).

Figure 4:
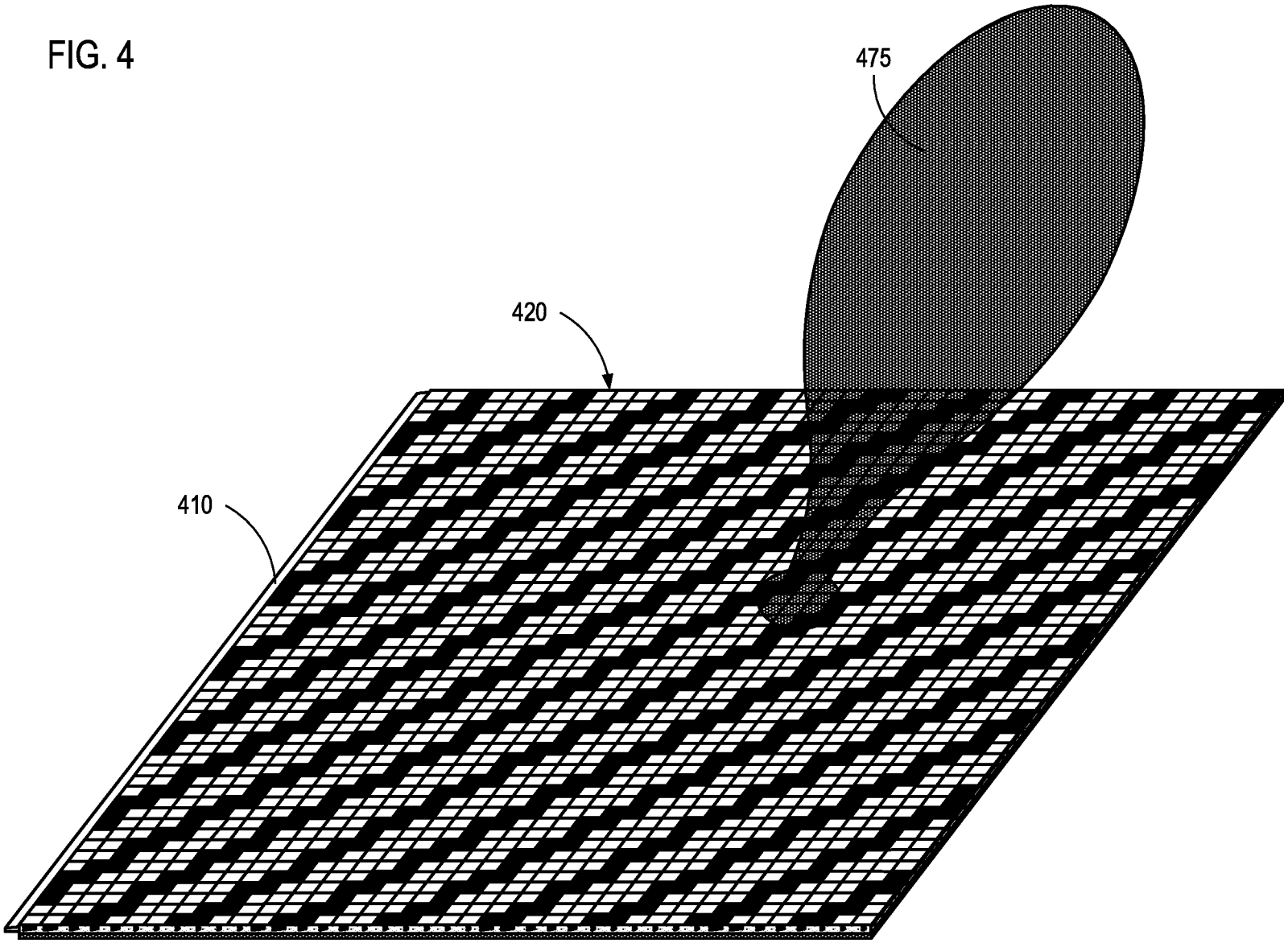
FIG. 4 illustrates a large-scale representation of an array of sub-wavelength transducer elements in which a subset of the sub-wavelength transducer elements are resonating at various electromagnetic frequencies and generating a corresponding beam-formed acoustic transmission pattern.

FIG. 4 illustrates a large-scale representation of an array of sub-wavelength transducer elements 420 in which a subset of the sub-wavelength transducer elements (shown in black) are resonating at one or more electromagnetic frequencies. The driven sub-wavelength transducer elements may generate a corresponding beam-formed acoustic transmission pattern 475. A controller 410 may dynamically alter (discretely or in sets) which of the sub-wavelength transducer elements are driven to generate an acoustic emission. Accordingly, the controller 410 may dynamically change the direction, intensity, focus, frequency, phase, and/or other characteristic of the acoustic transmission pattern 475.

Figure 5:
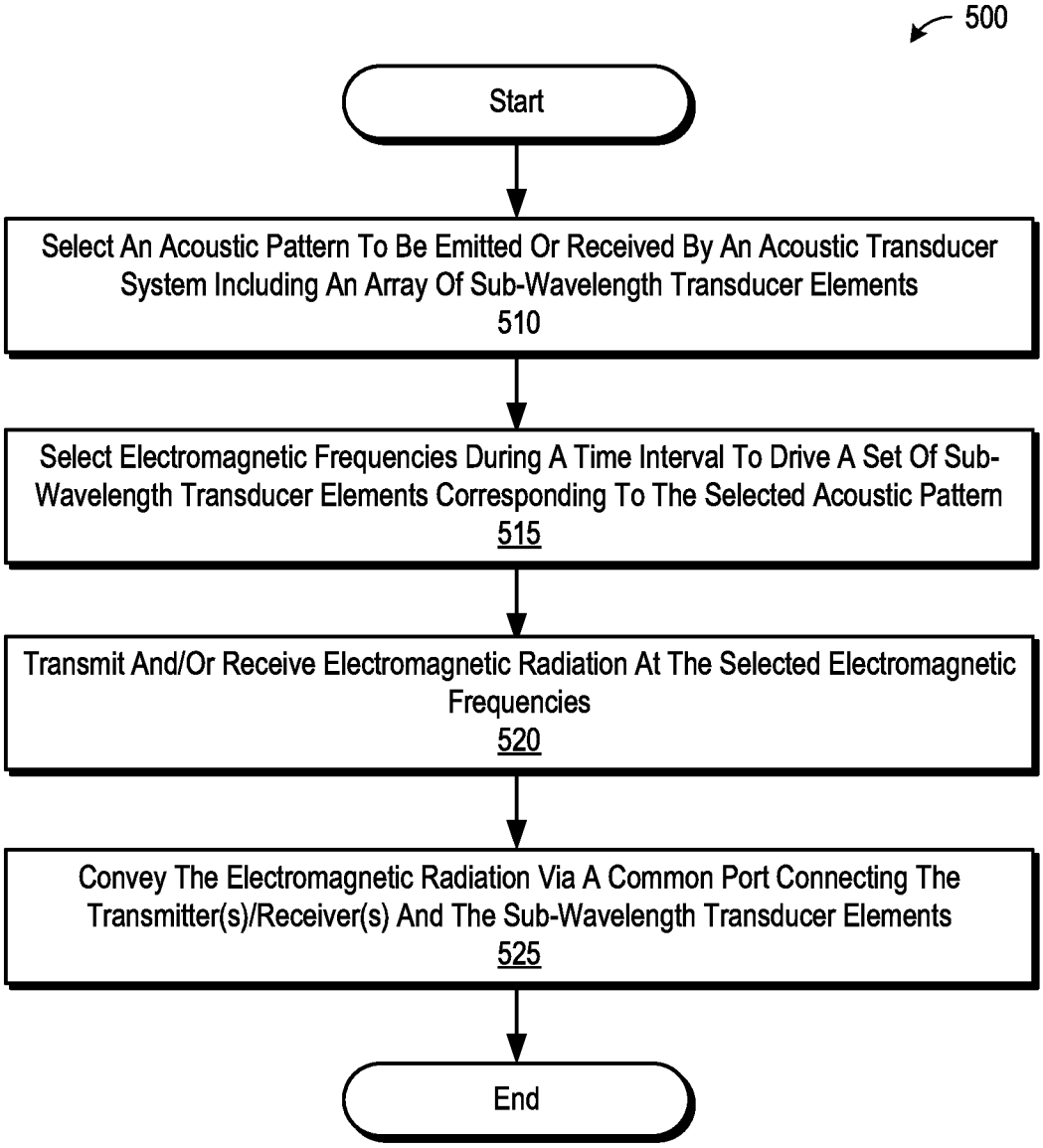
FIG. 5 illustrates a flow chart of a method for transmitting and/or receiving an acoustic pattern via an array of sub-wavelength transducer elements by selectively receiving electromagnetic energy from a subset of sub-wavelength transducer elements.

FIG. 5 illustrates a flow chart of a method 500 for transmitting and/or receiving an acoustic pattern via an array of sub-wavelength transducer elements by selectively receiving electromagnetic energy from a subset of sub-wavelength transducer elements. Initially, an acoustic pattern may be selected. The specific acoustic pattern may be selected 510 for emission or reception by an acoustic transducer system that includes an array of sub-wavelength transducer elements. A controller may determine and/or select 515 electromagnetic frequencies that will resonate with a set or sets of sub-wavelength transducer elements that, when made to generate acoustic emissions, will result in the specific acoustic pattern.

In various embodiments, sub-wavelength transducer elements may draw energy from the electromagnetic transmission. In other embodiments, the sub-wavelength transducer elements may be powered by a separate and/or independent source. The separate and/or independent power source may be controlled by the electromagnetic transmissions and/or via a separate or joint control unit.

The determined and/or selected 515 electromagnetic frequencies may be chosen for discrete time periods and/or time intervals to generate the specific acoustic pattern. The controller may cause a transmitter and/or receiver to transmit and/or receive 520 electromagnetic energy at the selected electromagnetic frequencies and times. The electromagnetic energy may then be conveyed 525 via a common port connecting the transmitter(s) and/or receiver(s) and the sub-wavelength transducer elements.

This disclosure has been made with reference to various exemplary embodiments, including the best mode. However, those skilled in the art will recognize that changes and modifications may be made to the exemplary embodiments without departing from the scope of the present disclosure. While the principles of this disclosure have been shown in various embodiments, many modifications of structure, arrangements, proportions, elements, materials, and components may be adapted for a specific environment and/or operating requirements without departing from the principles and scope of this disclosure. These and other changes or modifications are intended to be included within the scope of the present disclosure.

This disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element. The scope of the present invention should, therefore, be determined by the following claims.

What is claimed is:

1. A method for acoustic beam-forming, comprising:

selecting a specific acoustic transmission pattern to be emitted by a plurality of sub-wavelength transducer elements in an array of sub-wavelength transducer elements, the selected specific acoustic transmission pattern corresponding to respective electromagnetic resonance characteristics of at least some of the sub-wavelength transducer elements, wherein:

each sub-wavelength transducer element is configured with an electromagnetic resonance at one of a plurality of received electromagnetic frequencies; and each sub-wavelength transducer element is configured to generate an acoustic emission in response to the electromagnetic resonance, wherein a physical diameter of each individual sub-wavelength transducer element is less than one-half of an effective wavelength of the highest frequency of the acoustic emission;

transmitting, via a transmitter, electromagnetic energy at two or more electromagnetic frequencies to cause at least a subset of the sub-wavelength transducer elements to generate an ultrasonic acoustic emission that corresponds to the selected specific acoustic transmission pattern; and conveying the electromagnetic energy via a common port to each of the sub-wavelength transducer elements.

2. The method of claim 1, further comprising:

modifying, via a beam-forming controller, an electromagnetic resonance response of at least one of the sub-wavelength transducer elements in order to achieve the selected specific acoustic transmission pattern.

3. The method of claim 2, wherein modifying the electromagnetic resonance response of at least one of the sub-wavelength transducer elements comprises modifying one or more of:

an electromagnetic resonance of one or more of the sub-wavelength transducer elements to received electromagnetic energy; and an acoustic emission response to received electromagnetic energy at one or more resonant frequencies.

4. The method of claim of claim 3, further comprising modifying, using the beam-forming controller, the acoustic emission responses of sets of sub-wavelength transducer elements such that the transmitted electromagnetic energy effectuates sequential ultrasonic emissions by the sets of sub-wavelength transducer elements to form the selected specific transmission pattern.

5. The method of claim 2, wherein modifying the electromagnetic resonance response of at least one of the sub-wavelength transducer elements comprises assigning each sub-wavelength transducer element an electromagnetic resonance at one of a plurality of carrier electromagnetic frequencies, such that each sub-wavelength transducer element is configured to generate an acoustic emission at a transmission frequency corresponding to a modulation frequency on each respective carrier electromagnetic frequency.

6. The method of claim 5, wherein:

the array of sub-wavelength transducer elements comprises a plurality of sets of sub-wavelength transducer elements, including at least a first set and a second set;

each set of sub-wavelength transducer elements comprises at least one sub-wavelength transducer element; and each sub-wavelength transducer element within each respective set of sub-wavelength transducer elements is configured with an electromagnetic resonance at a carrier frequency unique to the sub-wavelength transducer element(s) within the respective set of sub-wavelength transducer elements.

7. The method of claim 6, wherein each sub-wavelength transducer element within the first set of sub-wavelength transducer elements is configured with an electromagnetic resonance at a first carrier frequency; and each sub-wavelength transducer element within the second set of sub-wavelength transducer elements is configured with an electromagnetic resonance at a second carrier frequency.

8. The method of claim 5, wherein each sub-wavelength transducer element is configured with an electromagnetic resonance at a unique frequency.

9. The method of claim 8, wherein:

each sub-wavelength transducer element is configured with an electromagnetic resonance at one of at least three different carrier frequencies; and the at least three different carrier frequencies are separated by at least twice a modulation bandwidth.

10. The method of claim 9, wherein each sub-wavelength transducer element is configured to generate an acoustic emission corresponding to a modulation frequency on each respective carrier frequency.

11. The method of claim 2, wherein the selected transmission pattern comprises a pulsed transmission in a first direction, and where a duration of the pulsed transmission is shorter than the effective width of the array divided by the propagation velocity of the acoustic emission in an associated transmission medium.

12. The method of claim 11, wherein the sets of sub-wavelength transducer elements each comprise an elongated set of sub-wavelength transducer elements extending substantially perpendicular to the first direction, and wherein the sequential ultrasonic emissions comprise sequential emissions by the series of elongated sets.

13. The method of claim 12, further comprising:

assigning, via the beam-forming controller, each elongated set of sub-wavelength transducer elements to an electromagnetic resonance at a unique carrier electromagnetic frequency in sequence from a first to a last carrier electromagnetic frequency;

configuring each sub-wavelength transducer element to generate an acoustic emission at a transmission frequency corresponding to a modulation frequency on each respective carrier electromagnetic frequency; and sweeping, via the transmitter, transmitted electromagnetic energy from the first carrier electromagnetic frequency to the last carrier electromagnetic frequency with a common modulation frequency, such that each sequential set of sub-wavelength transducer elements is made to emit an ultrasonic emission corresponding to the modulation frequency of the transmitted electromagnetic energy.

14. The method of claim 13, further comprising sweeping between each of the modulation frequencies at a speed corresponding to a propagation velocity of the acoustic emission.

15. The method of claim 1, wherein:

each sub-wavelength transducer element is configured with an electromagnetic resonance at one of a plurality of carrier electromagnetic frequencies; and each sub-wavelength transducer element is configured to generate an acoustic emission at a transmission frequency greater than a modulation frequency on each respective carrier electromagnetic frequency.

16. The method of claim 1, wherein the selected specific transmission pattern comprises an acoustic transmission at an angle relative to a planar surface of the array of sub-wavelength transducer elements.

17. The method of claim 1, wherein at least some of the sub-wavelength transducer elements comprise tunable active acoustic metamaterial transducers.

18. The method of claim 1, wherein the effective wavelength of the generated acoustic emission is greater than twice the physical diameter of the individual sub-wavelength transducer element.

19. An acoustic beam-forming system, comprising:

a plurality of sub-wavelength transducer elements arranged in an array for emitting a selected specific acoustic transmission pattern, the selected specific acoustic transmission pattern corresponding to respective electromagnetic resonance characteristics of at least some of the sub-wavelength transducer elements, wherein each individual sub-wavelength transducer element is configured to:

resonate at an electromagnetic resonance in response to at least one of a plurality of received electromagnetic frequencies; and generate an ultrasonic acoustic emission in response to the electromagnetic resonance, wherein a physical diameter of each individual sub-wavelength transducer element is less than one-half of an effective wavelength of the highest frequency of the acoustic emission;

a transmitter configured to generate a transmitted electromagnetic energy at two or more electromagnetic frequencies, the transmitted electromagnetic energy causing at least a subset of the sub-wavelength transducer elements to each generate an ultrasonic acoustic emission; and a common port configured to convey the transmitted electromagnetic energy to each of the sub-wavelength transducer elements.

20. The system of claim 19, wherein the common port is further configured such that the ultrasonic acoustic emissions generated by at least the subset of sub-wavelength transducer elements in response to the transmitted electromagnetic energy combine to collectively comprise the selected specific acoustic transmission pattern.

21. The system of claim 19, further comprising a beam-forming controller configured to modify an electromagnetic resonance response of at least one of the sub-wavelength transducer elements to the transmitted electromagnetic energy in order to thereby achieve the selected specific acoustic transmission pattern.

22. The system of claim 21, wherein the beam-forming controller is configured to modify the electromagnetic resonance response of at least one of the sub-wavelength transducer elements by modifying one or more of:

an electromagnetic resonance of one or more of the sub-wavelength transducer elements to received electromagnetic energy; and an acoustic emission response to received electromagnetic energy at one or more resonant frequencies.

23. The system of claim 19, wherein the selected specific transmission pattern comprises an acoustic transmission at an angle relative to a planar surface of the array of sub-wavelength transducer elements.

24. The system of claim 22, wherein the selected transmission pattern comprises a pulsed transmission in a first direction, and where a duration of the pulsed transmission is shorter than the effective width of the array divided by the propagation velocity of the acoustic emission in an associated transmission medium.

25. The system of claim 24, wherein the sets of sub-wavelength transducer elements each comprise an elongated set of sub-wavelength transducer elements extending substantially perpendicular to the first direction, and wherein the sequential ultrasonic emissions comprise sequential emissions by the series of elongated sets.

26. The system of claim 24, wherein:

the beam-forming controller is further configured to assign each elongated set of sub-wavelength transducer elements to an electromagnetic resonance at a unique carrier electromagnetic frequency in sequence from a first to a last carrier electromagnetic frequency;

each sub-wavelength transducer element is configured to generate an acoustic emission at a transmission frequency corresponding to a modulation frequency on each respective carrier electromagnetic frequency; and the transmitter is further configured to sweep transmitted electromagnetic energy from the first carrier electromagnetic frequency to the last carrier electromagnetic frequency with a common modulation frequency, such that each sequential set of sub-wavelength transducer elements is made to emit an ultrasonic acoustic emission corresponding to the modulation frequency of the transmitted electromagnetic energy.

27. The system of claim 22, wherein the beam-forming controller is further configured to modify the acoustic emission responses of sets of sub-wavelength transducer elements such that the transmitted electromagnetic energy effectuates sequential ultrasonic emissions by the sets of sub-wavelength transducer elements to form the selected specific transmission pattern.

28. The system of claim 21, wherein modifying the electromagnetic resonance response of at least one of the sub-wavelength transducer elements comprises assigning each sub-wavelength transducer element an electromagnetic resonance at one of a plurality of carrier electromagnetic frequencies, such that each sub-wavelength transducer element is configured to generate an acoustic emission at a transmission frequency corresponding to a modulation frequency on each respective carrier electromagnetic frequency.

29. The system of claim 19, wherein:

each sub-wavelength transducer element is configured to resonate at an electromagnetic resonance at one of a plurality of carrier electromagnetic frequencies; and each sub-wavelength transducer element is configured to generate an ultrasonic acoustic emission at a transmission frequency greater than a modulation frequency on each respective carrier electromagnetic frequency.

30. The system of claim 29, wherein each sub-wavelength transducer element is configured to resonate at an electromagnetic resonance at a unique frequency.

31. The system of claim 30, wherein:

each sub-wavelength transducer element is configured to resonate at an electromagnetic resonance at one of at least three different carrier frequencies; and the at least three different carrier frequencies are separated by at least twice a modulation bandwidth.

32. The system of claim 31, wherein the array of sub-wavelength transducer elements comprises a plurality of sets of sub-wavelength transducer elements, including at least a first set and a second set;

each set of sub-wavelength transducer elements comprises at least one sub-wavelength transducer element; and each sub-wavelength transducer element within each respective set of sub-wavelength transducer elements is configured to resonate at an electromagnetic resonance at a carrier frequency unique to the sub-wavelength transducer element(s) within the respective set of sub-wavelength transducer elements.

33. The system of claim 32, wherein:

each sub-wavelength transducer element within the first set of sub-wavelength transducer elements is configured to resonate at an electromagnetic resonance at a first carrier frequency; and each sub-wavelength transducer element within the second set of sub-wavelength transducer elements is configured to resonate at an electromagnetic resonance at a second carrier frequency.

34. The system of claim 33, wherein each sub-wavelength transducer element is configured to generate an acoustic emission corresponding to a modulation frequency on each respective carrier frequency.

35. The system of claim 19, wherein the transmitter is further configured to sweep between each of the modulation frequencies at a speed corresponding to the propagation velocity of the ultrasonic acoustic emission.

36. The system of claim 19, wherein at least some of the sub-wavelength transducer elements comprise tunable active acoustic metamaterial transducers.

37. The system of claim 19, wherein the one or more sub-wavelength transducer elements contained in the array are further configured to receive the transmitted electromagnetic energy conveyed by the common port and to generate in response one or more ultrasonic acoustic emissions that collectively comprise the selected specific acoustic pattern.

38. The system of claim 19, further comprising a beam-forming controller configured to modify an electromagnetic resonance response of at least one of the sub-wavelength transducer elements to the transmitted electromagnetic energy in order to thereby achieve the selected specific acoustic transmission pattern.

39. The system of claim 38, wherein the beam-forming controller is configured to modify the electromagnetic resonance response of at least one of the sub-wavelength transducer elements by modifying, for a given transducer element, one or more of: an electromagnetic resonance to received electromagnetic energy; and an acoustic emission response to received electromagnetic energy at one or more resonant frequencies.

40. The system of claim 38, wherein the beam-forming controller is configured to modify the electromagnetic resonance response of at least one of the sub-wavelength transducer elements by assigning each sub-wavelength transducer element an electromagnetic resonance at one of a plurality of carrier electromagnetic frequencies, such that each sub-wavelength transducer element is configured to generate an acoustic emission at a transmission frequency corresponding to a modulation frequency on each respective carrier electromagnetic frequency.

* * * * *